US011081126B2

(12) United States Patent
Baque et al.

(10) Patent No.: US 11,081,126 B2
(45) Date of Patent: Aug. 3, 2021

(54) PROCESSING OF SOUND DATA FOR SEPARATING SOUND SOURCES IN A MULTICHANNEL SIGNAL

(71) Applicant: ORANGE, Issy-les-Moulineaux (FR)

(72) Inventors: Mathieu Baque, Chatillon (FR); Alexandre Guerin, Chatillon (FR)

(73) Assignee: ORANGE

( * ) Notice: Subject to any disclaimer, the term of this patent is extended or adjusted under 35 U.S.C. 154(b) by 0 days.

(21) Appl. No.: 16/620,314

(22) PCT Filed: May 24, 2018

(86) PCT No.: PCT/FR2018/000139
§ 371 (c)(1),
(2) Date: Dec. 6, 2019

(87) PCT Pub. No.: WO2018/224739
PCT Pub. Date: Dec. 13, 2018

(65) Prior Publication Data

US 2020/0152222 A1 May 14, 2020

(30) Foreign Application Priority Data

Jun. 9, 2017 (FR) ..... 1755183

(51) Int. Cl.
*G10L 21/0308* (2013.01)
*G10L 21/0272* (2013.01)
(Continued)

(52) U.S. Cl.
CPC ..... *G10L 21/0308* (2013.01); *G10L 25/84* (2013.01); *H04R 5/02* (2013.01)

(58) Field of Classification Search
CPC ..... G10L 21/0272; G10L 21/02; G10L 21/00; G10L 21/0208; G10L 21/0264;
(Continued)

(56) References Cited

U.S. PATENT DOCUMENTS

2001/0037195 A1* 11/2001 Acero ..... G10L 25/78 704/200
2005/0060142 A1* 3/2005 Visser ..... G10L 21/0208 704/201
(Continued)

OTHER PUBLICATIONS

Mathieu Baque et al "Separation of Direct Sounds from Early Reflections using the Entropy Rate Bound Minimizaiton Algorithm", AES 60th International Conf., Leuven, Belgium, Feb. 3-5, pp. 1-8, (Year: 2016).*
(Continued)

*Primary Examiner* — Leshui Zhang
(74) *Attorney, Agent, or Firm* — David D. Brush; Westman, Champlin & Koehler, P.A.

(57) ABSTRACT

A method for processing sound data for separating N sound sources of a multichannel sound signal sensed in a real medium. The method includes: separating sources to the sensed multichannel signal and obtaining a separation matrix and a set of M sound components, with M≥N; calculating a set of bi-variate first descriptors representative of statistical relations between the components of the pairs of the set obtained of M components, calculating a set of uni-variate second descriptors representative of characteristics of encoding of the components of the set obtained of M components; and classifying the components of the set of M components, according to two classes of components, a first class of N direct components corresponding to the N direct sound sources and a second class of M−N reverberated components, by calculating probability of membership in one of the two classes, dependent on the sets of first and second descriptors.

14 Claims, 6 Drawing Sheets

(51) Int. Cl.
*G10L 25/84* (2013.01)
*H04R 5/02* (2006.01)

(58) Field of Classification Search
CPC ..... G10L 21/028; G10L 21/0308; G10L 2021/02161; G10L 2021/02163; G10L 2021/02165; G10L 2021/02166; G10L 2021/02082; G10L 2021/02087; G10L 25/78; G10L 25/81; G10L 25/84; G10L 25/87; G10L 25/90; G10L 25/93; G10L 25/935; G10L 25/937; G10L 2025/783; G10L 2025/786; G01S 3/8006; G01S 3/80; G01S 3/00; H04S 7/305; H04S 7/30; H04S 7/00; H04R 3/00; H04R 3/005; H04R 25/407; H04R 5/00; H04R 5/04
USPC ..... 704/231, 233, 237, 238, 240, 250, 263, 704/270, 272; 381/17–23, 94.2, 94.3
See application file for complete search history.

(56) References Cited

U.S. PATENT DOCUMENTS

2006/0034361 A1* 2/2006 Choi ..... H04R 5/04 375/224
2007/0260340 A1* 11/2007 Mao ..... H04R 3/005 700/94
2008/0208538 A1* 8/2008 Visser ..... G10L 21/0272 702/190
2008/0306739 A1* 12/2008 Nakajima ..... G10L 21/028 704/270
2009/0103738 A1* 4/2009 Faure ..... H04S 1/005 381/17
2009/0254338 A1* 10/2009 Chan ..... G10L 21/0272 704/205
2009/0292544 A1* 11/2009 Virette ..... H04S 3/02 704/501
2009/0310444 A1* 12/2009 Hiroe ..... G01S 3/8006 367/125
2010/0111290 A1* 5/2010 Namba ..... G10L 21/0208 379/392.01
2011/0015924 A1* 1/2011 Gunel Hacihabiboglu ..... H04R 3/005 704/231
2011/0058676 A1* 3/2011 Visser ..... 381/17
2013/0121495 A1* 5/2013 Mysore ..... G10L 21/0272 381/56
2015/0117649 A1* 4/2015 Nesta ..... H04S 7/305 381/17

OTHER PUBLICATIONS

Zaher El Chami et al "A New EM Algorithm for Underdetermined Convolutive Blind Source Separation", 17th European Signal Processing Conf., Glasgow, Scotland, Aug. 24-28, pp. 1457-1461, (Year: 2009).*
Taejin Park et al "Background Music Separation for Multichannel Audio Based on Inter-channel Level Vector Sum", IEEE ISCE Audio Researc Lab., Electronics and Telecommunications Research Institute ETRI, Daejon, Korea, South, pp. 1-2, (Year: 2014).*
Baque Mathieu et al., "Separation of Direct Sounds from Early Reflections Using Algorithm", Conference: 60th International Conference: Dreams (Dereverberation and Reverberation of Audio, Music, and Speech); Jan. 2016, AES, 60 East 42nd Street, Room 2520 New York 10165-2420, USA, Jan. 27, 2016 (Jan. 27, 2016), XP040680602.
Jourjine A. et al., "Blind Separation of Disjoint Orthogonal Signals; Demixing N Sources From 2 Mixtures", 2000 IEEE International Conference on Acoustics, Speech, and Signal Processing. Proceedings (ICASSP). Istanbul, Turkey, Jun. 5-9, 2000; IEEE International Conference on Acoustics, Speech, and Signal Processing (ICASSP)), New York, NY; IEEE, US, Jun. 5, 2000 (Jun. 5, 2000), pp. 2985-2988, XP001035813.
International Search Report dated Aug. 8, 2018 for corresponding International Application No. PCT/FR2018/000139, filed Mat 24, 2018.
Written Opinion of the International Searching Authority dated Aug. 8, 2018 for corresponding International Application No. PCT/FR2018/000139, filed Mat 24, 2018.
English translation of the Written Opinion of the International Searching Authority dated Aug. 17, 2018 for corresponding International Application No. PCT/FR2018/000139, filed Mat 24, 2018.

* cited by examiner

PROCESSING OF SOUND DATA FOR SEPARATING SOUND SOURCES IN A MULTICHANNEL SIGNAL

CROSS-REFERENCE TO RELATED APPLICATIONS

This Application is a Section 371 National Stage Application of International Application No. PCT/FR2018/000139, filed May 24, 2018, the content of which is incorporated herein by reference in its entirety, and published as WO 2018/224739 on Dec. 13, 2018, not in English.

FIELD OF THE DISCLOSURE

The present invention relates to the field of audio or acoustic signal processing, and more particularly to the processing of real multichannel sound content in order to separate the sound sources.

BACKGROUND OF THE DISCLOSURE

Separating sources in a multichannel sound signal allows numerous applications. It may be used for example:

For entertainment (karaoke: voice suppression),

For music (mixing separate sources in multichannel content),

For telecommunications (voice enhancement, noise elimination),

For home automation (voice control),

For multichannel audio coding,

For source location and cartography in imaging.

In a space E in which a number N of sources are transmitting a signal $s_i$, blindly separating the sources consists, based on a number M of observations from sensors distributed in this space E, in counting and extracting the number N of sources. In practice, each observation is obtained using a sensor that records the signal that has reached a point in the space where the sensor is situated. The recorded signal then results from the mixture and from the propagation in the space E of the signals $s_i$, and is therefore affected by various disturbances specific to the environment that is passed through, such as for example noise, reverberation, interference, etc.

The multichannel capturing of a number N of sound sources s, propagating in free-field conditions and considered to be points is formalized as a matrix operation:

$$x = As = \begin{bmatrix} a_{11} & \dots & a_{1N} \\ \vdots & \ddots & \vdots \\ a_{M1}(\theta_1, \phi_1, r_1) & \dots & a_{MN}(\theta_N, \phi_N, r_N) \end{bmatrix} * s$$

where x is the vector of the M recorded channels, s is the vector of the N sources and A is a matrix called "mixture matrix" of size M×N, containing the contributions of each source to each observation, and the sign * symbolizes linear convolution. Depending on the propagation environment and the format of the antenna, the matrix A may adopt various forms. In the case of a coincident antenna (all of the microphones of the antenna are concentrated at one and the same point in space), in an anechoic environment, A is a simple gains matrix. In the case of a non-coincident antenna, in an anechoic or reverberant environment, the matrix A becomes a filter matrix. In this case, the relationship is generally expressed in the frequency domain x(f)=As(f), where A is expressed as a matrix of complex coefficients.

If the sound signal is captured in an anechoic environment, and taking the scenario in which the number of sources N is less than the number of observations M, analyzing (i.e. identifying the number of sources and their positions) and breaking down the scene into objects, i.e. the sources, may easily be achieved jointly using an independent component analysis (or "ICA" hereinafter) algorithm. These algorithms make it possible to identify the separation matrix B of dimensions N×M, the pseudo-inverse of A, which makes it possible to deduce the sources from the observations using the following equation:

$$s=Bx$$

The preliminary step of estimating the dimension of the problem, i.e. estimating the size of the separation matrix, that is to say the number of sources N, is conventionally performed by calculating the rank of the covariance matrix $Co=E\{xx^T\}$ of the observations, which, in this anechoic case, is equal to the number of sources:

$$N=\mathrm{rank}(Co).$$

With regard to the location of the sources, this may be deduced from the encoding matrix $A=B^{-1}$ and from knowledge of the spatial properties of the antenna that is used, in particular the distance between the sensors and their directivities.

Among the best-known ICA algorithms, mention may be made of JADE by J. F Cardoso and A. Souloumiac ("*Blind beamforming for non-gaussian signals*" in "IEE Proceedings F—Radar and Signal Processing", volume 140, issue 6, December 1993) or Infomax by Amari et. al. ("A new learning algorithm for blind signal separation, Advances" in "neural information processing systems", 1996).

In practice, in certain conditions, the separation step s=Bx amounts to beamforming: the combination of various channels given by the matrix B consists in applying a spatial filter whose directivity amounts to imposing unity gain in the direction of the source that it is desired to extract, and zero gain in the direction of the interfering sources. One example of beamforming for extracting three sources positioned respectively at 0°, 90° and −120° azimuth is illustrated in FIG. 1. Each of the directivities formed corresponds to the extraction of one of the sources of s.

In the presence of a mixture of sources captured in real conditions, the room effect will generate what is called a reverberant sound field, denoted $x_r$, that will be added to the direct fields of the sources:

$$x=As+x_r.$$

The total acoustic field may be modeled as the sum of the direct field of the sources of interest (shown at 1 in FIG. 2), of the first reflections (secondary sources, shown at 2 in FIG. 2) and of a diffuse field (shown at 3 in FIG. 2). The covariance matrix of the observations is then of full rank, regardless of the real number of active sources in the mixture: this means that it is no longer possible to use the rank of Co to estimate the number of sources.

Thus, when using an SAS algorithm to separate sources in a reverberant environment, the separation matrix B of size M×M is obtained, generating M sources $\tilde{s}_j$, $1 \le j \le M$ at output, rather than the desired N, the last M−N components essentially containing reverberant field, using the matrix operation:

$$\tilde{s}=B\cdot x$$

These additional components pose numerous problems:

for scene analysis: it is not known a priori which components relate to the sources and which components are induced by the room effect.

for separating sources through beamforming: each additional component induces constraints on the directivities that are formed and generally degrades the directivity factor, resulting in an increase in the reverberation level in the extracted signals.

Existing source-counting methods for multichannel content are often based on an assumption of parsimony in the time-frequency domain, that is to say on the fact that, for each time-frequency bin, a single source or a limited number of sources will have a non-negligible power contribution. For the majority of these, a step of locating the most powerful source is performed for each bin, and then the bins are aggregated (called "clustering" step) in order to reconstruct the total contribution of each source.

The DUET (for "*Degenerate Unmixing Estimation Technique*") approach, described for example in the document "Blind separation of disjoint orthogonal signals: Demixing n sources from 2 mixtures." by the authors A. Jourjine, S. Rickard, and O. Yilmaz, published in 2000 in ICASSP'00, makes it possible to locate and extract N sources in anechoic conditions based on only two non-coincident observations, by assuming that the sources have separate frequency supports, that is to say $$S_i(f)S_j(f)=0$$

for all values of f provided that $i \neq j$.

After breaking down the observations into frequency sub-bands, typically performed via a short-term Fourier transform, an amplitude $a_i$ and a delay $t_i$ are estimated for each sub-band based on the theoretical mixture equation:

$$\begin{bmatrix} X_1(f) \\ X_2(f) \end{bmatrix} = \begin{bmatrix} 1 & \dots & 1 \\ a_1 e^{-i\omega t_1} & \dots & a_N e^{-i\omega t_N} \end{bmatrix} \cdot \begin{bmatrix} S_1(f) \\ \dots \\ S_N(f) \end{bmatrix}$$

In each frequency band f, a pair ($a_i$, $t_i$) corresponding to the active source i is estimated as follows:

$$\begin{cases} a_i = \left\| \dfrac{X_2(f)}{X_1(f)} \right\| \\ t_i = \dfrac{1}{2\pi f} \mathcal{F}\left\{ \log \dfrac{X_2(f)}{X_1(f)} \right\} \end{cases}$$

A representation in space of all of the pairs ($a_i$, $t_i$) is performed in the form of a histogram, the "clustering" is then performed on the histogram by way of a likelihood maximum depending on the position of the bin and on the assumed position of the associated source, assuming a Gaussian distribution of the estimated positions of each bin around the real position of the sources.

In practice, the assumption of parsimony of the sources in the time-frequency domain often fails, thereby constituting a significant limitation of these approaches for counting sources, as the pointed directions of arrival for each bin then result from a combination of the contributions of a plurality of sources and the "clustering" is no longer performed correctly. In addition, for analyzing content captured in real conditions, the presence of reverberation may firstly degrade the location of the sources and secondly lead to an overestimation of the number of real sources when first reflections reach a power level high enough to be perceived as secondary sources.

SUMMARY

The present invention aims to improve the situation. To this end, it proposes a method for processing sound data in order to separate N sound sources of a multichannel sound signal captured in a real environment. The method is such that it comprises the following steps:

- applying source separation processing to the captured multichannel signal and obtaining a separation matrix and a set of M sound components, where $M \geq N$;
- calculating a set of what are called bivariate first descriptors, representative of statistical relationships between the components of the pairs of the obtained set of M components;
- calculating a set of what are called univariate second descriptors, representative of encoding characteristics of the components of the obtained set of M components;
- classifying the components of the set of M components into two classes of components, a first class of N components called direct components corresponding to the N direct sound sources and a second class of M−N components called reverberant components, using a calculation of probability of belonging to one of the two classes, depending on the sets of first and second descriptors.

This method therefore makes it possible to discriminate the components originating from direct sources and the components originating from reverberation of the sources when the multichannel sound signal is captured in a reverberant environment, that is to say with room effect. The set of bivariate first descriptors thus makes it possible to determine firstly whether the components of a pair of the set of components obtained following the source separation step forms part of one and the same class of components or of a different class, whereas the set of univariate second descriptors makes it possible to define, for a component, whether it has more probability of belonging to a particular class. This therefore makes it possible to determine the probability of a component belonging to one of the two classes, and thus to determine the N direct sound sources corresponding to the N components classified into the first class.

The various particular embodiments mentioned hereinafter may be added independently or in combination with one another to the steps of the processing method defined above.

In one particular embodiment, calculating a bivariate descriptor comprises calculating a coherence score between two components.

This descriptor calculation makes it possible to ascertain, in a relevant manner, whether a pair of components corresponds to two direct components (2 sources) or whether at least one of the components stems from a reverberant effect.

According to one embodiment, calculating a bivariate descriptor comprises determining a delay between the two components of the pair.

This determination of the delay and of the sign associated with this delay makes it possible to determine, for a pair of components, which component more probably corresponds to the direct signal and which component more probably corresponds to the reverberant signal.

According to one possible implementation of this descriptor calculation, the delay between two components is determined by taking into account the delay that maximizes an intercorrelation function between the two components of the pair.

This method for obtaining the delay offers determination of a reliable bivariate descriptor.

In one particular embodiment, the determination of the delay between two components of a pair is associated with an indicator of reliability of the sign of the delay, which depends on the coherence between the components of the pair.

In one variant embodiment, the determination of the delay between two components of a pair is associated with an indicator of reliability of the sign of the delay, which depends on the ratio of the maximum of an intercorrelation function for delays of opposing sign.

These reliability indicators make it possible to make the probability more reliable, for a pair of components belonging to a different class, of each component of the pair being the direct component or the reverberant component.

According to one embodiment, the calculation of a univariate descriptor is dependent on matching between mixture coefficients of a mixture matrix estimated on the basis of the source separation step and the encoding features of a plane-wave source.

This descriptor calculation makes it possible, for a single component, to estimate the probability of the component being direct or reverberant.

In one embodiment, the components of the set of M components are classified by taking into account the set of M components and by calculating the most probable combination of the classifications of the M components.

In one possible implementation of this overall approach, the most probable combination is calculated by determining a maximum of the likelihood values expressed as the product of the conditional probabilities associated with the descriptors, for the possible classification combinations of the M components.

In one particular embodiment, a step of preselecting the possible combinations is performed on the basis of just the univariate descriptors before the step of calculating the most probable combination.

This thus reduces the likelihood calculations to be performed on the possible combinations, since this number of combinations is restricted by this preselection step.

In one variant embodiment, a step of preselecting the components is performed on the basis of just the univariate descriptors before the step of calculating the bivariate descriptors.

The number of bivariate descriptors to be calculated is thus restricted, thereby reducing the complexity of the method.

In one exemplary embodiment, the multichannel signal is an ambisonic signal.

This processing method thus described is perfectly applicable to this type of signal.

The invention also relates to a sound data processing device implemented so as to perform separation processing of N sound sources of a multichannel sound signal captured by a plurality of sensors in a real environment. The device is such that it comprises:

- an input interface for receiving the signals captured by a plurality of sensors, of the multichannel sound signal;
- a processing circuit containing a processor and able to implement:
  - a source separation processing module applied to the captured multichannel signal in order to obtain a separation matrix and a set of M sound components, where $M \geq N$;
  - a calculator able to calculate a set of what are called bivariate first descriptors, representative of statistical relationships between the components of the pairs of the obtained set of M components and a set of what are called univariate second descriptors, representative of encoding characteristics of the components of the obtained set of M components;
  - a module for classifying the components of the set of M components into two classes of components, a first class of N components called direct components corresponding to the N direct sound sources and a second class of M−N components called reverberant components, using a calculation of probability of belonging to one of the two classes, depending on the sets of first and second descriptors;
- an output interface for delivering the classification information of the components.

The invention also applies to a computer program containing code instructions for implementing the steps of the processing method as described above when these instructions are executed by a processor and to a storage medium able to be read by a processor and on which there is recorded a computer program comprising code instructions for executing the steps of the processing method as described.

The device, program and storage medium have the same advantages as the method described above that they implement.

BRIEF DESCRIPTION OF THE DRAWINGS

Other features and advantages of the invention will become more clearly apparent on reading the following description, given purely by way of nonlimiting example and with reference to the appended drawings, in which.

DETAILED DESCRIPTION OF ILLUSTRATIVE EMBODIMENTS

Figure 1:
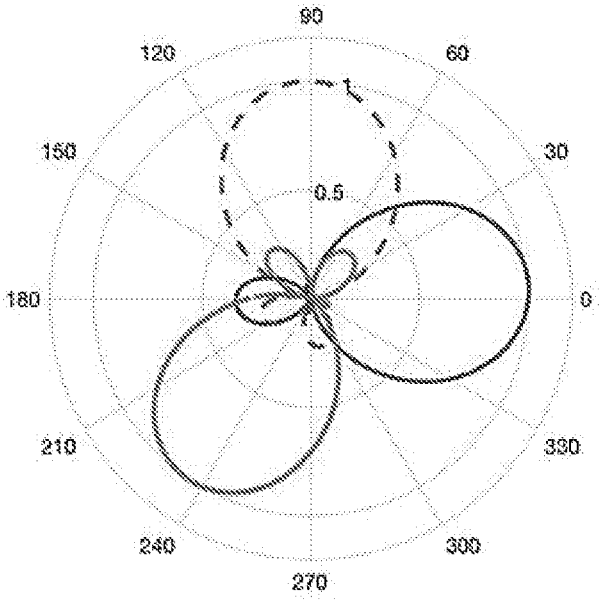
FIG. 1 illustrates beamforming in order to extract three sources using a source separation method from the prior art as described above.
Figure 2:
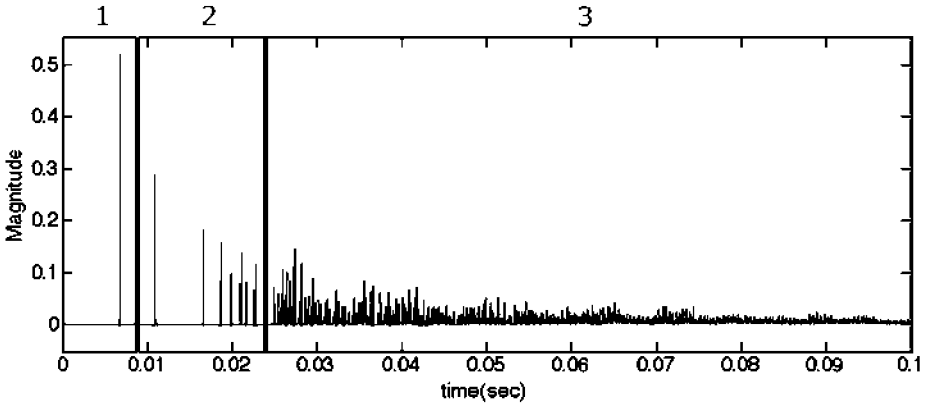
FIG. 2 illustrates an impulse response with room effect as described above.
Figure 3:
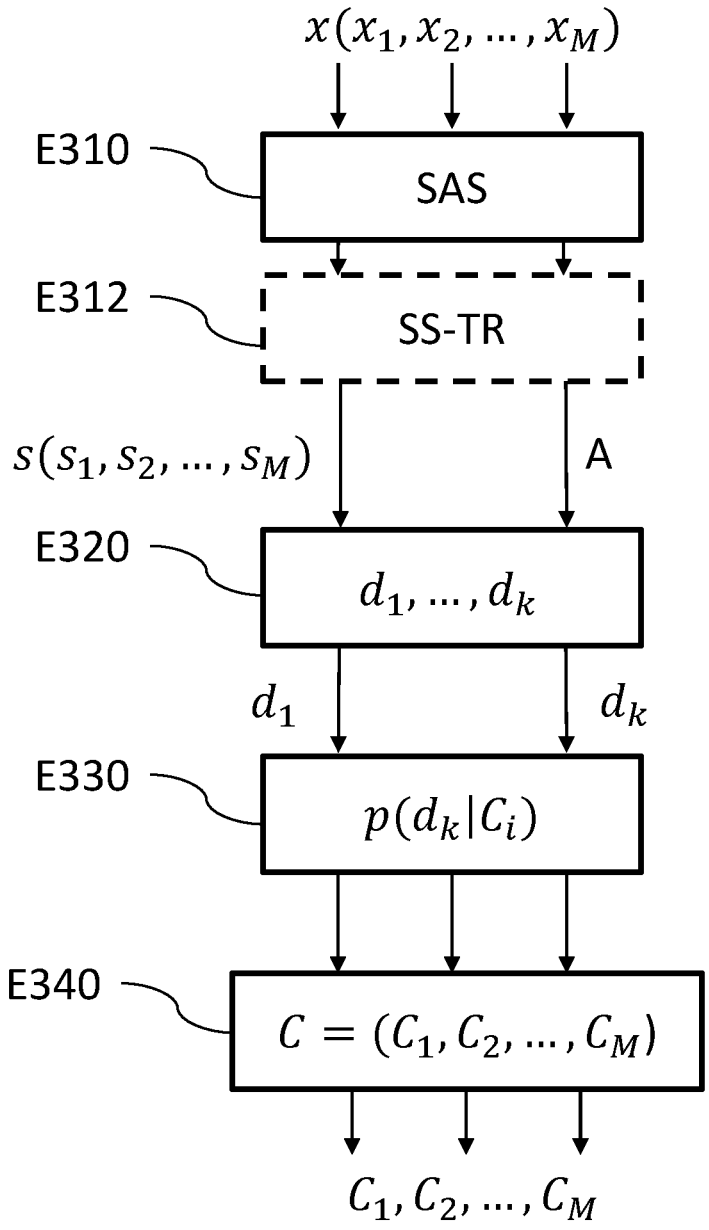
FIG. 3 illustrates, in the form of a flowchart, the main steps of a processing method according to one embodiment of the invention.

FIG. 3 illustrates the main steps of a method for processing sound data in order to separate N sound sources of a multichannel sound signal captured in a real environment in one embodiment of the invention.

Thus, starting from a multichannel signal captured by a plurality of sensors placed in a real environment, that is to say reverberant environment, and delivering a number M of observations from these sensors ($x(x_1, \ldots, x_M)$), the method implements a step E310 of blindly separating sound sources (SAS). It is assumed here in this embodiment that the number of observations is equal to or greater than the number of active sources.

Using a blind source separation algorithm applied to the M observations makes it possible, in the case of a reverberant environment, through beamforming, to extract M sound components associated with an estimated mixture matrix $A_{M\times M}$, that is to say:

s=Bx where x is the vector of the M observations, B is the separation matrix estimated by blindly separating sources, of dimensions M×M, and s is the vector of the M extracted sound components. These theoretically include N sound sources and M−N residual components corresponding to reverberation.

To obtain the separation matrix B, the blind source separation step may be implemented, for example using an independent component analysis (or "ICA") algorithm or else a main component analysis algorithm.

In one exemplary embodiment, ambisonic multichannel signals are of interest.

Ambisonics consists in projecting the acoustic field onto a base of spherical harmonic functions in order to obtain a spatialized representation of the sound scene. The function $Y_{mn}^{\sigma}(\theta,\phi)$ is the spherical harmonic of order m and of index nσ, dependent on the spherical coordinates (θ, ϕ), defined using the following formula:

$$Y_{mn}^{\sigma}(\theta, \phi) = \tilde{P}_{mn}(\cos\phi)\cdot\begin{cases}\cos n\theta & \sigma = 1\\ \sin n\theta & \sigma = -1 \quad n \geq 1\end{cases}$$

where $\tilde{P}_{mn}(\cos\phi)$ is a polar function involving the Legendre polynomial:

$$\tilde{P}_{mn}(x) = \sqrt{\epsilon_n \frac{(m-n)!}{(m+n)!}}\,(-1)^n(1-x^2)^{\frac{n}{2}}\frac{d^n}{dx^n}P_m(x) \text{ where}$$

$$\epsilon_0 = 1 \text{ and } \epsilon_0 = 2 \text{ for } n \geq 1 \text{ and } P_m(x) = \frac{1}{2^m\cdot m!}\frac{d^n}{dx^n}(x^2-1)^m$$

In practice, real ambisonic encoding is performed based on a network of sensors that are generally distributed over a sphere. The captured signals are combined in order to synthesize ambisonic content the channels of which comply as far as possible with the directivities of the spherical harmonics. The basic principles of ambisonic encoding are described below.

Ambisonic formalism, which was initially limited to representing 1st-order spherical harmonic functions, has since been expanded to higher orders. Ambisonic formalism with a higher number of components is commonly called "higher order ambisonics" (or "HOA" below).

2m+1 spherical harmonic functions correspond to each order m. Thus, content of order m contains a total of $(m+1)^2$ channels (4 channels at the 1st order, 9 channels at the 2nd order, 16 channels at the 3rd order, and so on).

"Ambisonic components" are understood hereinafter to be the ambisonic signal in each ambisonic channel, with reference to the "vector components" in a vector base that would be formed by each spherical harmonic function. Thus, for example, it is possible to count:

one ambisonic component for the order m=0,
three ambisonic components for the order m=1,
five ambisonic components for the order m=2,
seven ambisonic components for the order m=3, etc.

The ambisonic signals that are captured for these various components are then distributed over a number M of channels that results from the maximum order m that it is intended to capture in the sound scene. For example, if a sound scene is captured using an ambisonic microphone having 20 piezoelectric capsules, then the maximum captured ambisonic order is m=3, so that there are not more than 20 channels $M=(m+1)^2$, the number of ambisonic components under consideration is 7+5+3+1=16 and the number M of channels is M=16, also given by the relationship $M=(m+1)^2$, with m=3.

Thus, in the exemplary implementation in which the multichannel signal is an ambisonic signal, step E310 receives the signals $x(x_1, \ldots, x_1, \ldots, x_M)$, captured by a real microphone, in a reverberating environment that receives frames of ambisonic sound content on $M=(m+1)^2$ channels and containing N sources.

The sources are therefore blindly separated in step E310 as explained above.

This step makes it possible to simultaneously extract M components and the estimated mixture matrix. The components obtained at the output of the source separation step may be classified into two classes of components: a first class of components called direct components corresponding to the direct sound sources and a second class of components called reverberant components corresponding to the reflections of the sources.

In step E320, descriptors of the M components ($s_1$, $s_2$, . . . $s_M$) from the source separation step are calculated, which descriptors will make it possible to associate, with each extracted component, the class that corresponds thereto: direct component or reverberant component.

Two types of descriptors are calculated here: bivariate descriptors that involve pairs of components ($s_j$, $s_i$) and univariate descriptors calculated for a component $s_i$.

A set of bivariate first descriptors is thus calculated. These descriptors are representative of statistical relationships between the components of the pairs of the obtained set of M components.

Three scenarios may be modeled depending on the respective classes of the components:

The two components are direct fields,
One of the two components is direct and the other is reverberant,
The two components are reverberant.

According to one embodiment, an average coherence is calculated in this case between two components. This type of descriptor represents a statistical relationship between the components of a pair, and provides an indication as to the presence of at least one reverberant component in a pair of components.

Specifically, each direct component consists primarily of the direct field of a source, similar to a plane wave, plus a residual reverberation whose power contribution is less than that of the direct field. As the sources are statistically independent by nature, there is therefore a low correlation between the extracted direct components.

By contrast, each reverberant component consists of first reflections, delayed and filtered versions of the direct field or fields, and of a delayed reverberation. The reverberant components thus have a significant correlation with the direct components, and generally a group delay able to be identified in relation to the direct components.

The coherence function $\gamma_{jl}^2$ provides information about the existence of a correlation between two signals $s_j$ and $s_l$ and is expressed using the formula:

$$\gamma_{jl}^2(f) = \frac{|\Gamma_{jl}(f)|^2}{\Gamma_j(f)\Gamma_l(f)}$$

where $\Gamma_{jl}(f)$ is the interspectrum between $s_j$ and $s_l$ and $\Gamma_j(f)$ are $\Gamma_l(f)$ are the respective autospectra of $s_j$ and $s_i$.

The coherence is ideally zero when $s_j$ are $s_i$ are the direct fields of independent sources, but it adopts a high value when $s_j$ and $s_i$ are two contributions from one and the same source: the direct field and a first reflection or else two reflections.

Such a coherence function therefore indicates a probability of having two direct components or two contributions from one and the same source (direct/reverberant or first reflection/subsequent reflections).

In practice, the interspectra and autospectra may be calculated by dividing the extracted components into K frames (adjacent or with overlap), by applying a short-term Fourier transform to each frame k of these K frames in order to produce the instantaneous spectra $S_j(k, f)$, and by averaging the observations on the K frames:

$$\Gamma_{jl}(f)=E_{k\in\{1\ldots K\}}\{S_j(k,f)S_k^*(k,f)\}$$

The descriptor used for a wideband signal is the average over all of the frequencies of the coherence function between two components, that is to say:

$$d^{65}(s_j,s_l)=E_f\{\gamma_{jl}^2(f)\}$$

As the coherence is bounded between 0 and 1, the average coherence will also be contained within this interval, tending toward 0 for perfectly independent signals and toward 1 for highly correlated signals.

Figure 4:
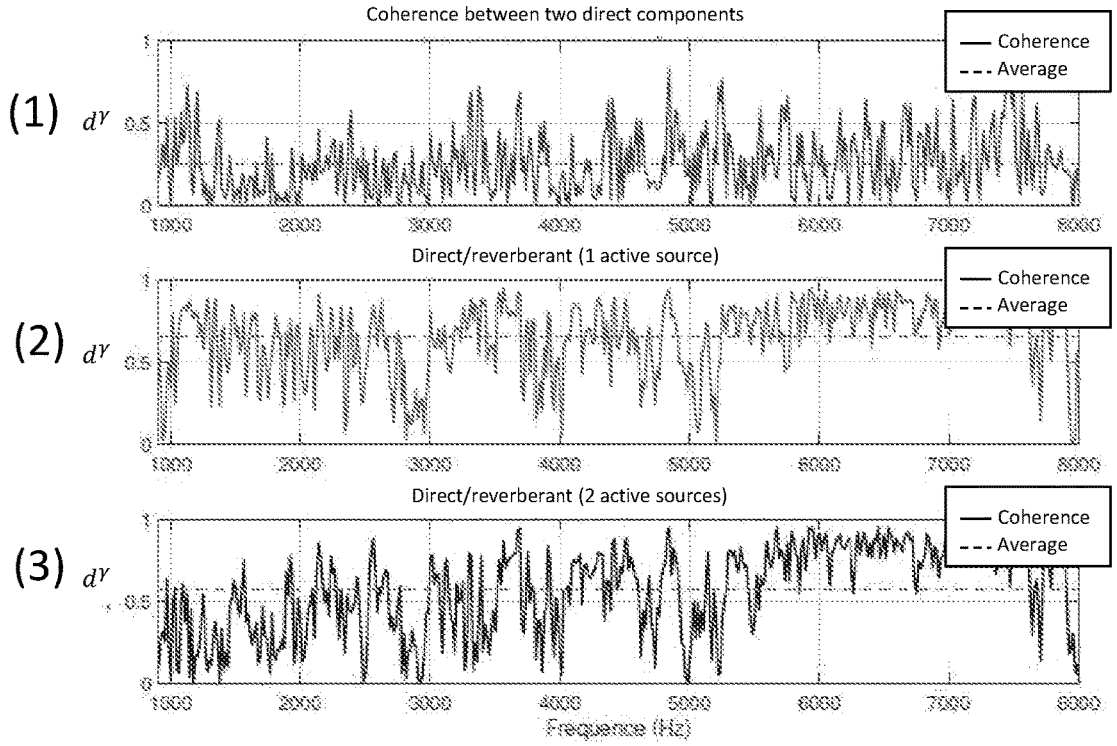
FIG. 4 illustrates, as a function of frequency, coherence functions representing bivariate descriptors between two components according to one embodiment of the invention, and using various pairs of components.

FIG. 4 gives an overview of the coherence values as a function of the frequency for the following cases:

- Case no. 1 in which the coherence values are obtained for two direct components from 2 separate sources.
- Case no. 2 in which the coherence values are obtained for a pair of direct and reverberant components for a single active source.
- Case no. 3 in which the coherence values are obtained for a pair of direct and reverberant components but when two sources are active simultaneously.

It is noted that, in the first case, the coherence value $d^\gamma$ is less than 0.3, whereas, in the second case, $d^\gamma$ reaches 0.7 in the presence of a single active source. These values readily reflect both the independence of the direct signals and the relationship linking a direct signal and the same reverberant signal in the absence of interference. However, by incorporating a second active source into the initial mixture (case no. 3), the average coherence of the direct/reverberant case drops to 0.55 and is highly dependent on the spectral content and the power level of the various sources. In this case, the competition between the various sources causes the coherence to drop at low frequencies, whereas the values are higher above 5500 Hz due to a lower contribution of the interfering source.

It is therefore noted that determining a probability of belonging to one and the same class or to a different class for a pair of components may depend on the number of sources that are active a priori. For the classification step E340 described below, this parameter may be taken into account in one particular embodiment.

In step E330 of FIG. 3, a probability calculation is deduced from the descriptor thus described.

In practice, the probability densities in FIGS. 5 and 7 described below, and more generally all of the probability densities of the descriptors, are learned statistically from databases comprising various acoustic conditions (reverberant/dull) and various sources (male/female voice, French/English/etc. languages). The components are classified in an informed manner: the extracted component that is spatially closest is associated with each source, the remaining components being classified as reverberant components. To calculate the position of the component, the 4 first coefficients of its mixture vector from the matrix A (that is to say 1st-order), the inverse of the separation matrix B, are used. Assuming that this vector complies with the encoding rule for a plane wave, that is to say:

$$\begin{bmatrix} 1 \\ \cos\theta\cos\varphi \\ \sin\theta\cos\varphi \\ \sin\varphi \end{bmatrix}$$

where (θ, φ) represent the spherical coordinates, azimuth/elevation, of the source, it is possible to deduce, through simple trigonometric calculations, the position of the extracted component using the following set of equations:

$$\begin{cases} \theta = \arctan2\left(\frac{a_3}{a_2}\right) \\ \varphi = \arctan2\left(\frac{a_4 * \mathrm{sign}(a_1)}{\sqrt{a_2^2 + a_3^2}}\right) \end{cases}$$

where arctan 2 is the arctangent function that makes it possible to remove the ambiguity regarding the sign of the arctangent function.

Figure 9:
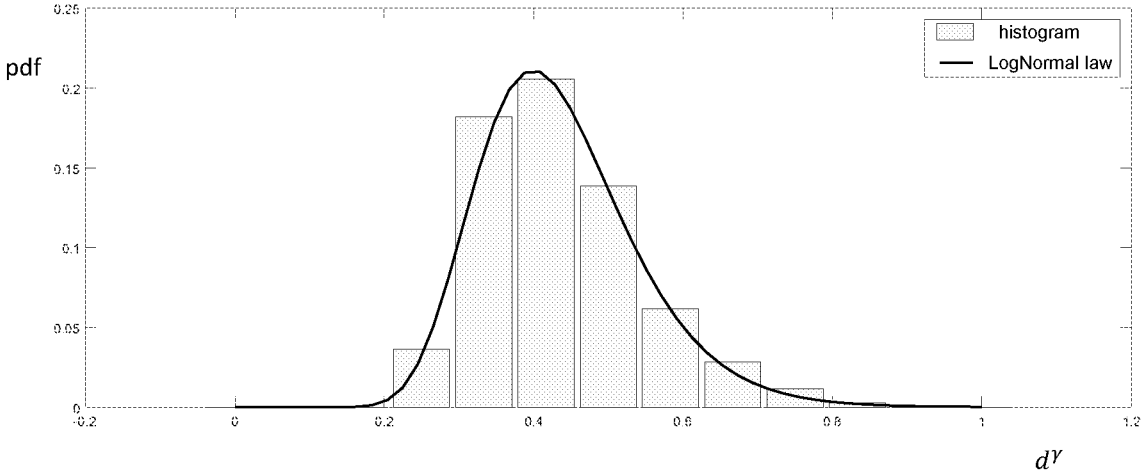
FIG. 9 illustrates one example of calculating a probability law for a coherence criterion between a direct component and a reverberant component according to one embodiment of the invention.

Once the signals have been classified, the various descriptors are calculated. A histogram of values of the descriptor is extracted from the points cloud—from the database—for a given class, from which one probability density is chosen from among a collection of probability densities, on the basis of a distance, generally the Kullback-Leibler divergence. FIG. 9 shows one example of calculating a law for the coherence criterion between a direct component and a reverberant component: the log-normal law has been selected from among around ten laws as it minimizes the Kullback-Leibler divergence.

Figure 5:
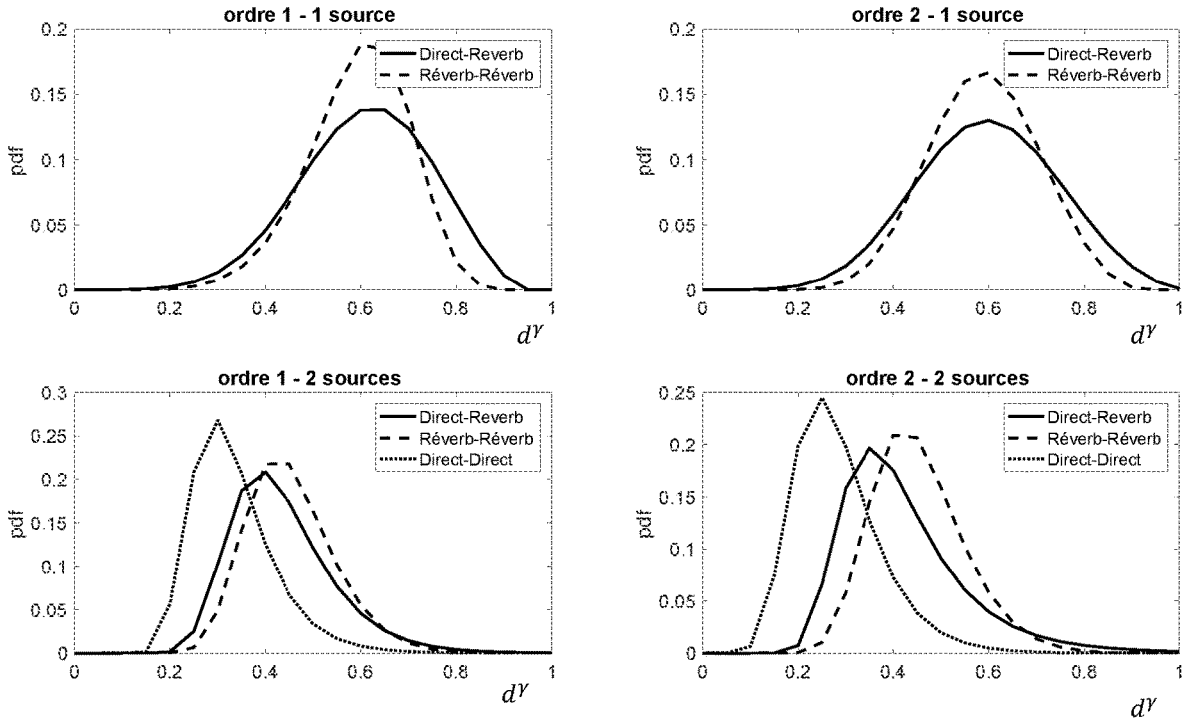
FIG. 5 illustrates the probability densities of the average coherences representative of the bivariate descriptors according to one embodiment of the invention and for various pairs of components and various numbers of sources.

For the example of an ambisonic signal, FIG. 5 shows the distributions (probability density or pdf for "probability density function") associated with the value of the average coherence between two components.

The probability laws shown here are presented for 4-channel (1st-order ambisonics) or 9-channel (2nd-order ambisonics) microphonic capturing, in the case of one or two sources that are simultaneously active. It is first of all observed that the average coherence $d^{\gamma}$ adopts significantly lower values for pairs of direct components in comparison with the cases in which at least one of the components is reverberant, and this observation is all the more pronounced the higher the ambisonic order. This is due to improved selectivity of the beamforming when the number of channels is greater, and therefore to improved separation of the extracted components.

It is also observed that, in the presence of two active sources, the coherence estimators degrade, whether these be the direct/reverberant or reverberant/reverberant pairs (the direct/direct pair does not exist in the presence of a single source).

Definitively, it appears that the probability densities depend greatly on the number of sources in the mixture, and on the number of sensors available.

This descriptor is therefore relevant for detecting whether a pair of extracted components corresponds to two direct components (2 true sources) or whether at least one of the two components stems from the room effect.

In one embodiment of the invention, another type of bivariate descriptor is calculated in step E320. This descriptor is either calculated instead of the coherence descriptor described above or in addition thereto.

This descriptor will make it possible to determine, for a (direct/reverberant) pair, which component is more probably the direct signal and which one corresponds to the reverberant signal, based on the simple assumption that the first reflections are delayed and attenuated versions of the direct signal.

This descriptor is based on another statistical relationship between the components, the delay between the two components of the pair. The delay $\tau_{jl,max}$ is defined as being the delay that maximizes the intercorrelation function $r_{jl}(\tau)=E_t\{s_j(t)s_l(t-\tau)\}$ between the components of a pair of components $s_j$ and $s_l$:

$$\tau_{jl,max} = \underset{\tau}{\operatorname{argmax}}|r_{jl}(\tau)|$$

When $s_j$ is a direct signal and $s_l$ is an associated reflection, the trace of the intercorrelation function will generally result in a negative $\tau_{jl,max}$. Thus, if it is known that a pair of direct/reverberant components is present, it is thus theoretically possible to assign the class to each of the components by virtue of the sign of $\tau_{jl,max}$.

In practice, the estimation of the sign of $\tau_{jl,max}$ max is often highly impacted by noise, or even sometimes inverted:

When the scene consists of a single source, there is not necessarily any group delay that emerges separately if the reverberant field is formed of multiple reflections and of delayed reverberation. In addition, the direct components extracted by SAS still contain a larger or smaller residual room effect that will add noise to the measurement of the delay.

When a plurality of sources are present, the interference disturbs the measurement, to a greater extent if the analysis frames are short and all of the direct fields have not been perfectly separated.

For these reasons, it is possible to choose to make the sign of $\tau_{jl,max}$ used as a descriptor reliable by virtue of a robustness or reliability indicator.

The average coherence between the components makes it possible to evaluate the relevance of the direct/reverberant pair as seen above. If this is high, it may be hoped that the group delay will be a reliable descriptor.

Figure 6:
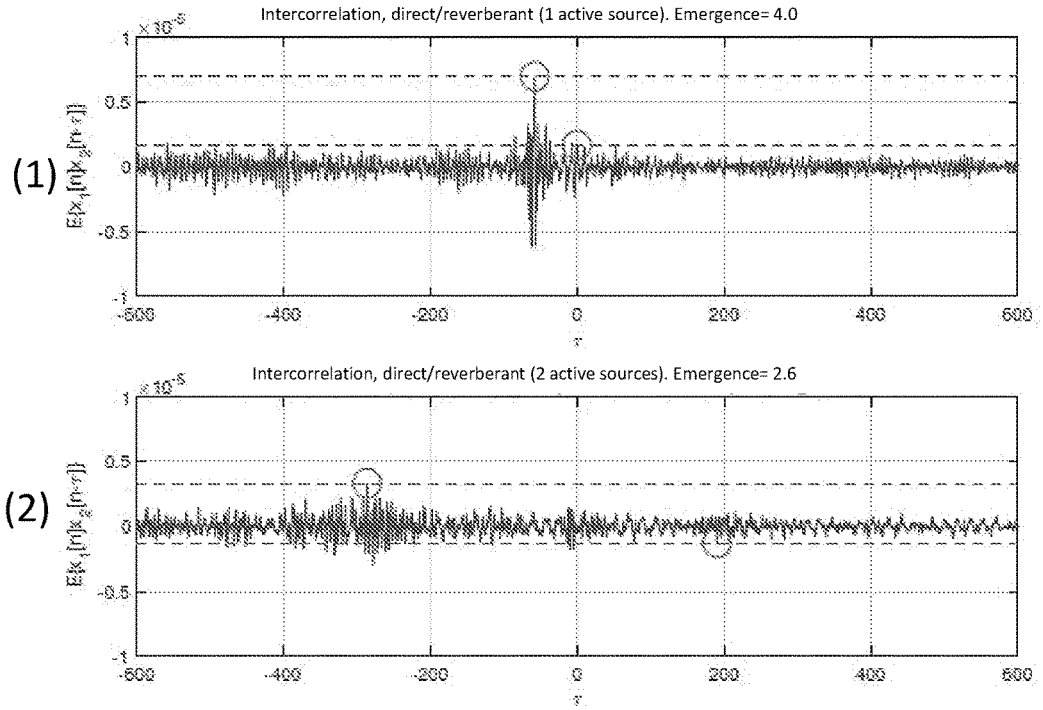
FIG. 6 illustrates intercorrelation functions between two components of different classes according to one embodiment of the invention and depending on the number of sources.

On the other hand, the relative value of the intercorrelation peak $\tau_{jl,max}$ with respect to the other values of the intercorrelation function $r_{jl}(r)$ also provides information about the reliability of the group delay. FIG. 6 illustrates the emergent nature of the autocorrelation peak between a direct component and a reverberant component. In the upper part (1) of FIG. 6, in which a single source is present, the intercorrelation maximum clearly emerges from the rest of the intercorrelation, reliably indicating that one of the components is delayed with respect to the other. It emerges in particular with respect to the values of the autocorrelation function for signs opposite that of $\tau_{jl,max}$ (that of the positive $\tau$ in FIG. 6) that are very low, regardless of the value of $\tau$.

In one particular embodiment, a second indicator of reliability of the sign of the delay, called emergence, is defined by calculating the ratio between the absolute value of the intercorrelation at $\tau_{max}$ and that of the correlation maximum for $\tau$ of a sign opposite that of $\tau_{jl,max}$:

$$\text{emergence}_{jl} = \left|\frac{r_{jl}(\tau_{jl,max})}{r_{jl}(\bar{\tau}_{jl,max})}\right|$$

where $\bar{\tau}_{jl,max}$ is defined by:

$$\bar{\tau}_{jl,max} = \arg \max_{sign(\tau)\neq sign(\tau_{jl,max})} |r_{jl}(\tau)|$$

This ratio, which is called emergence, is an ad hoc criterion the relevance of which is proven in practice: it adopts values close to 1 for independent signals, i.e. 2 direct components, and higher values for correlated signals, such as a direct component and a reverberant component. In the abovementioned case of curve (1) in FIG. 6, the emergence value is 4.

There is therefore a descriptor $d^{\tau}$ that determines, for each assumed direct/reverberant pair, the probability of each component of the pair being the direct component or the reverberant component. This descriptor is dependent on the sign of $\tau_{max}$, on the average coherence between the components and on the emergence of the intercorrelation maximum.

It should be noted that this descriptor is sensitive to noise, and in particular to the presence of a plurality of simultaneous sources, as illustrated on curve (2) of FIG. 6: in the presence of 2 sources, even though the correlation maximum still emerges, its relative value—2.6—is lower due to the presence of an interfering source, which reduces the correlation between the extracted components. In one particular embodiment, the reliability of the sign of the delay will be measured depending on the value of the emergence, which will be weighted by the a priori number of sources to be detected.

Using this descriptor, in step E330, a probability of belonging to a first class of direct components or a second class of reverberant components is calculated for a pair of components. For $s_j$ identified as being ahead of $s_l$, the probability of $s_j$ being direct and $s_l$ being reverberant is estimated using a two-dimensional law.

Logically, the probability of $s_j$ being reverberant and $s_l$ being direct even though $s_j$ is in phase advance is then estimated as the 1's complement of the direct/reverberant case:

$$p(\mathcal{C}_j=\mathcal{C}^r, \mathcal{C}_l=\mathcal{C}^d|d^\tau)=1=p(\mathcal{C}_j=\mathcal{C}^d, C_l=\mathcal{C}^r|d^\tau)$$

where $C_j$ and $C_l$ are the respective classes of the components $s_j$ and $s_l$, $C^d$ being the first class of components, called direct components, corresponding to the N direct sound sources and $C^r$ being the second class of M−N components, called reverberant components.

This descriptor is able to be used only for direct/reverberant pairs. The direct/direct and reverberant/reverberant pairs are not taken into consideration by this descriptor, and they are therefore considered to be equally probable:

$$\begin{cases} p(C_j = C^d, C_l = C^d \mid d^\tau) = 0.5 \\ p(C_j = C^r, C_l = C^r \mid d^\tau) = 0.5 \end{cases}$$

The sign of the delay is a reliable indicator when both the coherence and the emergence have medium or high values. A low emergence or a low coherence will make the direct/reverberant or reverberant/direct pairs equally probable.

In step E320, a set of what are called univariate second descriptors, representative of encoding characteristics of the components of the obtained set of M components, is also calculated.

With knowledge of the capturing system that is used, a source coming from a given direction is encoded using mixture coefficients that depend, inter alia, on the directivity of the sensors. If the source is able to be considered as a point and if the wavelengths are long in comparison with the size of the antenna, the source may be considered to be a plane wave. This scenario is generally proven in the case of a small ambisonic microphone, provided that the source is far enough away from microphone (one meter is enough in practice).

For a component $s_j$ extracted by SAS, the $j^{th}$ column of the estimated mixture matrix A, obtained by inverting the separation matrix B, will contain the mixture coefficients associated therewith. If this component is direct, that is to say it corresponds to a single source, the mixture coefficients of column Aj will tend towards characteristics of microphonic encoding for a plane wave. In the case of a reverberant component, which is the sum of a plurality of reflections and a diffuse field, the estimated mixture coefficients will be more random and will not correspond to the encoding of a single source with a precise direction of arrival.

It is therefore possible to use the conformity between the estimated mixture coefficients and the theoretical mixture coefficients for a single source in order to estimate a probability of the component being direct or reverberant.

In the case of 1st-order ambisonic microphonic capturing, a plane wave $s_j$ of incidence $(\theta_j, \phi_j)$ in what is known as the N3D ambisonic format is encoded using the formula:

$$x_j=A_j s_j$$

where $$A_j = \begin{bmatrix} a_{1j} \\ a_{2j} \\ a_{3j} \\ a_{4j} \end{bmatrix} = \begin{bmatrix} 1 \\ \sqrt{3}\cos\theta_j\cos\phi_j \\ \sqrt{3}\sin\theta_j\cos\phi_j \\ \sqrt{3}\sin\theta_j \end{bmatrix}$$

Specifically, there are several ambisonic formats that are distinguished in particular by the normalization of the various components grouped in terms of order. The known N3D format is considered here. The various formats are described for example at the following link: https://en.wikipedia.org/wiki/Ambisonic_data_exchange_format.

It is thus possible to deduce, from the encoding coefficients of a source, a criterion, called plane wave criterion, that illustrates the conformity between the estimated mixture coefficients and the theoretical equation of a single encoded plane wave:

$$c_{op} = \sqrt{\frac{3a_{1j}^2}{a_{2j}^2 + a_{3j}^2 + a_{4j}^2}}$$

The criterion $c_{op}$ is by definition equal to 1 in the case of a plane wave. In the presence of a correctly identified direct field, the plane wave criterion will remain very close to the value 1. By contrast, in the case of a reverberant component, the multitude of contributions (first reflections and delayed reverberation) with equivalent power levels will generally move the plane wave criterion away from its ideal value.

For this descriptor, as for the others, the associated distribution calculated at E330 has a certain variability, depending in particular on the level of noise present in the extracted components. This noise consists primarily of the residual reverberation and contributions from the interfering sources that will not have been perfectly canceled out. To refine the analysis, it is therefore possible to choose to estimate the distribution of the descriptors depending:

- On the number of channels that are used (therefore in this case on the ambisonic order), which influences the selectivity of the beamforming and therefore the residual noise level,
- on the number of sources contained in the mixture (as for the previous descriptors), the increase in which leads mechanically to an increase in the noise level and a greater variance in the estimation of the separation matrix B, and therefore A.

Figure 7:
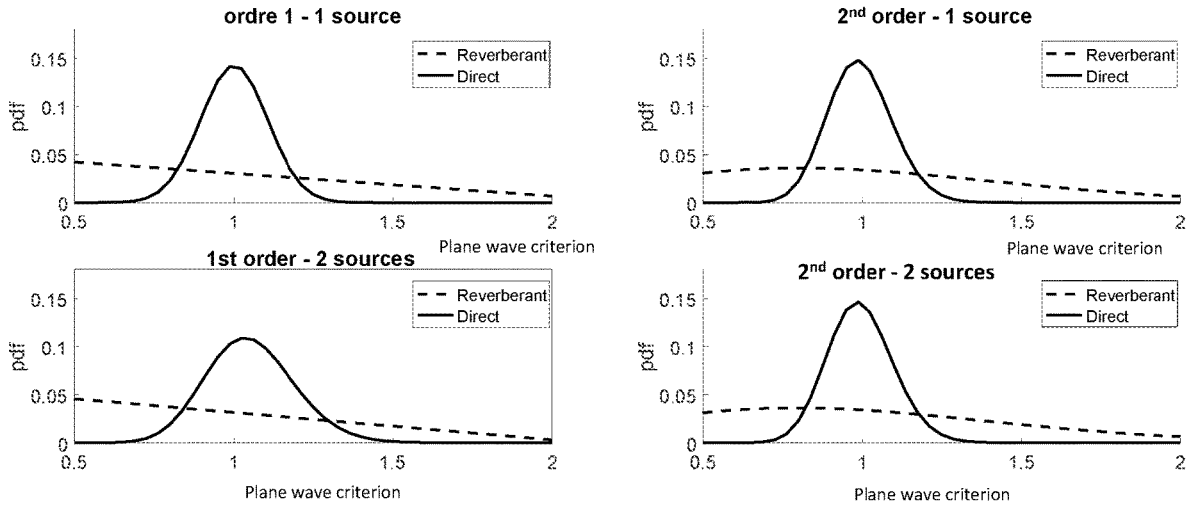
FIG. 7 illustrates the probability densities of a plane-wave criterion as a function of the class of the component, of the ambisonic order and of the number of sources, for one particular embodiment of the invention.

FIG. 7 shows the probability laws (probability density) associated with this descriptor, depending on the number of simultaneously active sources (1 or 2) and on the ambisonic order of the analyzed content (1st to 2nd orders). According to the initial assumption, the value of the plane wave criterion is concentrated around the value 1 for the direct components. For the reverberant components, the distribution is more uniform, but with a slightly asymmetric form, due to the descriptor itself, which is asymmetric, with a form of 1/x.

The distance between the distributions of the two classes allows relatively reliable discrimination between the plane wave components and those that are more diffuse.

The descriptors calculated in step E320 and disclosed here are thus based both on the statistics of the extracted components (average coherence and group delay) and on the estimated mixture matrix (plane wave criterion). These make it possible to determine conditional probabilities of a component belonging to one of the two classes $C^d$ or $C^r$.

From the calculation of these probabilities, it is then possible, in step E340, to determine a classification of the components of the set of M components into the two classes.

For a component $s_j$, $C_j$ denotes the corresponding class. With regard to classifying the set of M extracted components, "configuration" is the name given to the vector of the classes C of dimension 1×M such that:

$$C=[C_1,C_2,\ldots,C_M] \text{ where } C_j \in \{C^d,C^r\}$$

With the knowledge that there are two possible classes for each component, the problem ultimately amounts to choosing from among a total of $2^M$ potential configurations assumed to be equally probable. To achieve this, the rule of the a posteriori maximum is applied: knowing $L(C_i)$ to be the likelihood of the $i^{th}$ configuration, the configuration that is used will be the one having the maximum likelihood, that is to say:

$$C=arg\ \max_{Ci} L(C_i), \forall 1 \le i \le 2^M$$

The chosen approach may be exhaustive and then consist in estimating the likelihood of all of the possible configurations based on the descriptors determined in step E320 and the distributions associated therewith that are calculated in step E330.

According to another approach, the configurations may be preselected in order to reduce the number of configurations to be tested, and therefore the complexity of implementing the solution. This preselection may be performed for example using the plane wave criterion alone, by classifying some components into the category $C^r$, provided that the value of their criterion $c_{op}$ moves far enough away from the theoretical value of a plane wave 1: in the case of ambisonic signals, it is possible to see, in the distributions of FIG. 7, that it is possible, regardless of the configuration (order or number of sources) and a priori without a loss of robustness, to classify the components whose $c_{op}$ satisfies one of the following inequalities into the category $C^r$:

$$\begin{cases} c_{op} < 0.7 \\ c_{op} > 1.5 \end{cases}$$

This preselection makes it possible to reduce the number of configurations to be tested by pre-classifying certain components, excluding the configurations that impose the class $C^d$ on these pre-classified components.

Another possibility for reducing the complexity even further is that of excluding the pre-classified components from the calculation of the bivariate descriptors and from the likelihood calculation, thereby reducing the number of bivariate criteria to be calculated and therefore even further reducing the processing complexity.

A naive Bayesian approach may be used to estimate the likelihood of each configuration using the calculated descriptors. In this type of approach, there is provided set of descriptors $d_k$ for each component $s_j$. For each descriptor, the probability of the component $s_j$ belonging to the class $C^\alpha$ ($\alpha$=d or r) is formulated using Bayes' law:

$$p(C_j = C^\alpha \mid d_k) = \frac{p(C_j = C^\alpha)p(d_k \mid C_j = C^\alpha)}{p(d_k)}$$

With the two classes $C^r$ and $C^d$ being assumed to be equally probable, this means that:

$$p(C_j = C^\alpha) = \frac{1}{2} \forall \alpha$$

and $$p(d_k) = \frac{p(d_k \mid C = C^r) + p(d_k \mid C = C^d)}{2}$$

We then obtain:

$$p(C^\alpha \mid d_k) = \frac{p(d_k \mid C^\alpha)}{p(d_k \mid C^r) + p(d_k \mid C^d)}$$

in which the term $C^j=C^\alpha$ is abbreviated to $C^\alpha$ in order to simplify the notation. As this in this case involves looking for the likelihood maximum, the term on the denominator of each conditional probability is constant regardless of the configuration that is evaluated. Therefore, it is then possible to simplify the expression thereof:

$$p(\mathcal{C}^\alpha | d_k) \propto p(d_k | \mathcal{C}^\alpha)$$

For a bivariate descriptor (such as for example coherence) involving two components $s_j$ and $s_l$ and their respective assumed classes, the previous expression is expanded:

$$p(\mathcal{C}_j = \mathcal{C}^\alpha, \mathcal{C}_l = \mathcal{C}^\beta | d_k) \propto p(d_k | \mathcal{C}^\alpha, \mathcal{C}^\beta)$$

and so on.

The likelihood is expressed as the product of the conditional probabilities associated with each of the K descriptors, if it is assumed that these are independent:

$$L(C) = p(d \mid C) = \prod_{k=1}^{K} p(d_k \mid C)$$

where d is the vector of the descriptors and C is a vector representing a configuration (that is to say the combination of the assumed classes of the M components), as defined above.

More precisely, a number $K_1$ of univariate descriptors is used for each of the components, whereas a number $K_2$ of bivariate descriptors is used for each pair of components. As the probability laws for the descriptors are established on the basis of the assumed number of sources and on the number of channels (the index m represents the ambisonic order in the case of capturing of this type), the final expression of the likelihood is then formulated as follows:

$$L(C) = \prod_{j=1}^{M} \left( \prod_{k=1}^{K_1} p(d_k(j) \mid C_j, N, m) \prod_{l=j+1}^{M} \prod_{k=1}^{K_2} p(d_k(j,l) \mid C_j, C_l, N, m) \right)$$

where $d_k(j)$ is the value of the descriptor of index k for the component $s_j$;

$d_k(j,l)$ is the value of the bivariate descriptor of index k for the components $s_j$ and $s_l$;

$C_j$ et $C_l$ are the assumed classes of the components j and l;

N is the number of active sources associated with the configuration that is evaluated:

$$N = \sum_{j=1}^{M} (C_j = C^d)$$

For calculation-based reasons, rather than the likelihood, preference is given to its logarithmic version (log-likelihood):

$$LL(C) = \sum_{j=1}^{M} \left( \sum_{k=1}^{K_1} \log p(d_k(j) \mid C_j, N, m) + \sum_{l=j+1}^{M} \sum_{k=1}^{K_2} \log p(d_k(j, l) \mid C_j, C_l, N, m) \right)$$

This equation is the one used definitively to determine the most likely configuration in the Bayesian classifier described here for this embodiment.

The Bayesian classifier presented here is just one exemplary implementation, and it could be replaced, inter alia, by a support vector machine or a neural network.

Ultimately, the configuration having the likelihood maximum is used, indicating the direct or reverberant class associated with each of the M components $C(C_1, \ldots, C_i, \ldots, C_M)$.

In this combination, the N components corresponding to the N active direct sources are therefore deduced.

The processing described here is performed in the time domain, but may also, in one variant embodiment, be applied in a transformed domain.

The method as described with reference to FIG. 3 is then implemented in frequency sub-bands after changing to the transformed domain of the captured signals.

Moreover, the useful bandwidth may be reduced depending on the potential imperfections of the capturing system, at high frequencies (presence of spatial aliasing) or at low frequencies (impossible to find the theoretical directivities of the microphonic encoding).

Figure 8:
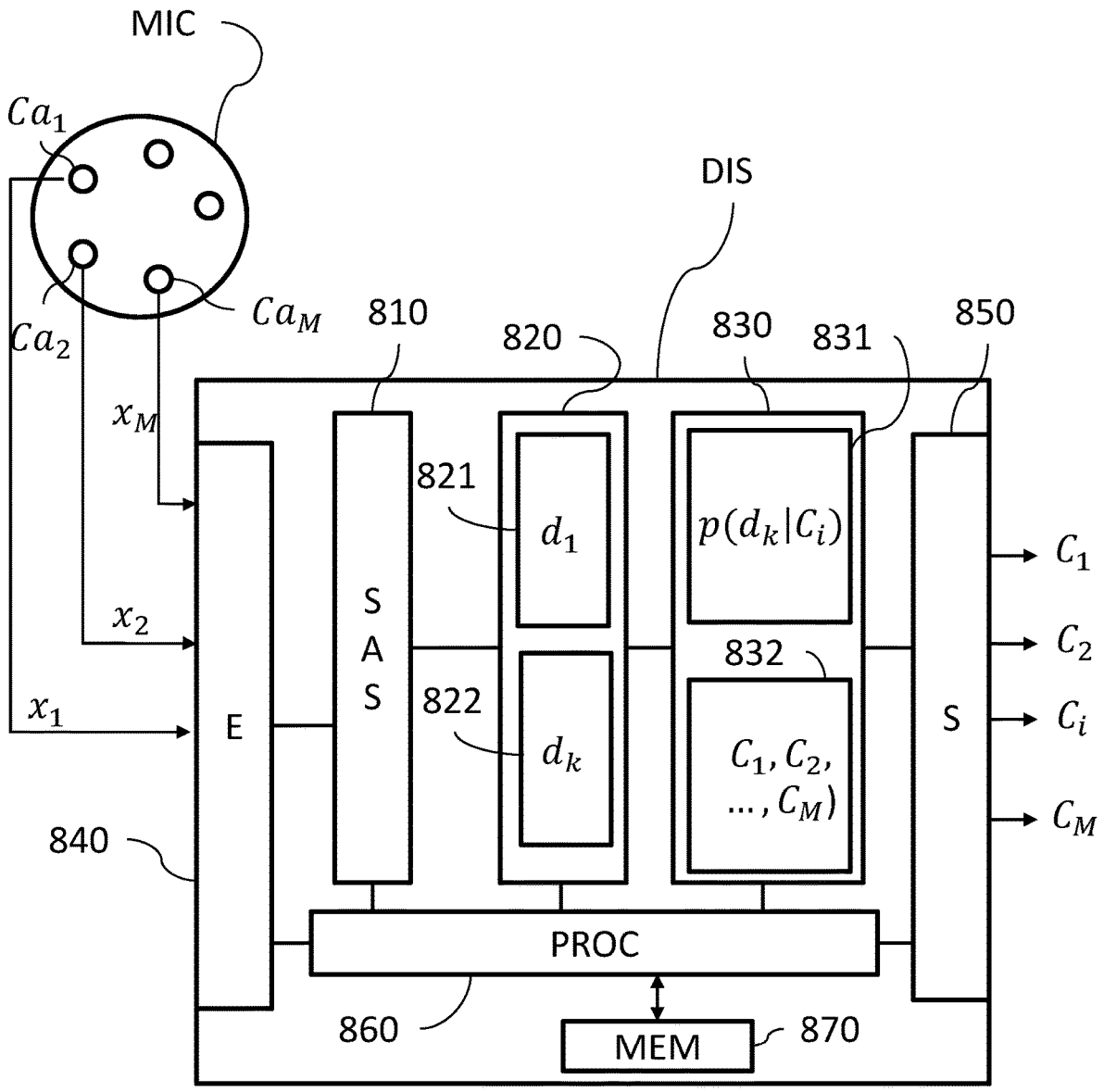
FIG. 8 illustrates a hardware representation of a processing device according to one embodiment of the invention, implementing a processing method according to one embodiment of the invention.

FIG. 8 in this case shows one embodiment of a processing device (DIS) according to one embodiment of the invention.

Sensors $Ca_1$ to $Ca_M$, shown here in the form of a spherical microphone MIC, make it possible to acquire, in a real and therefore reverberant medium, M mixture signals x $(x_1, \ldots, x_i, \ldots, x_M)$, from a multichannel signal.

Of course, other forms of microphone or sensor may be provided. These sensors may be integrated into the device DIS or else outside the device, the signals resulting therefrom then being transmitted to the processing device, which receives them via its input interface 840. In one variant, these signals may simply be obtained beforehand and imported into the memory of the device DIS.

These M signals are then processed by a processing circuit and computerized means, such as a processor PROC at 860 and a working memory MEM at 870. This memory may contain a computer program containing code instructions for implementing the steps of the processing method as described for example with reference to FIG. 3 and in particular steps of applying source separation processing to the captured multichannel signal and obtaining a set of M sound components, where M≥N, of calculating a set of what are called bivariate first descriptors, representative of statistical relationships between the components of the pairs of the obtained set of M components and a set of what are called univariate second descriptors, representative of encoding characteristics of the components of the obtained set of M components and of classifying the components of the set of M components into two classes of components, a first class of N components called direct components corresponding to the N direct sound sources and a second class of M−N components called reverberant components, using a calculation of probability of belonging to one of the two classes, depending on the sets of first and second descriptors.

The device thus contains a source separation processing module 810 applied to the captured multichannel signal in order to obtain a set of M sound components s $(s_1, \ldots, s_i, \ldots, s_M)$, where M≥N. The M components are provided at the input of a calculator 820 able to calculate a set of what are called bivariate first descriptors, representative of statistical relationships between the components of the pairs of the obtained set of M components and a set of what are called univariate second descriptors, representative of encoding characteristics of the components of the obtained set of M components.

These descriptors are used by a classification module 830 or classifier, able to classify components of the set of M components into two classes of components, a first class of N components called direct components corresponding to the N direct sound sources and a second class of M−N components called reverberant components.

For this purpose, the classification module contains a module 831 for calculating a probability of belonging to one of the two classes of the components of the set M, depending on the sets of first and second descriptors.

The classifier uses descriptors linked to the correlation between the components in order to determine which are direct signals (that is to say true sources) and which are reverberation residuals. It also uses descriptors linked to the mixture coefficients estimated by SAS, in order to evaluate the conformity between the theoretical encoding of a single source and the estimated encoding of each component. Some of the descriptors are therefore dependent on a pair of components (for the correlation), and others are dependent on a single component (for the conformity of the estimated microphonic encoding).

A likelihood calculation module 832 makes it possible to determine, in one embodiment, the most probable combination of the classifications of the M components by way of a likelihood value calculation depending on the probabilities calculated at the module 831 and for the possible combinations.

Lastly, the device contains an output interface 850 for delivering the classification information of the components, for example to another processing device, which may use this information to enhance the sound of the discriminated sources, to eliminate noise from them or else to mix a plurality of discriminated sources. Another possible processing operation may also be that of analyzing or locating the sources in order to optimize the processing of a voice command.

Many other applications using the classification information thus determined are then possible.

The device DIS may be integrated into a microphonic antenna in order for example to capture sound scenes or to record a voice command. The device may also be integrated into a communication terminal able to process signals captured by a plurality of sensors integrated into or remote from the terminal.

Although the present disclosure has been described with reference to one or more examples, workers skilled in the art will recognize that changes may be made in form and detail without departing from the scope of the disclosure and/or the appended claims.

The invention claimed is:

1. A method for processing sound data in order to separate N sound sources of a multichannel sound signal captured in a real environment, wherein the method comprises the following acts performed by a sound data processing device:

receiving the captured multichannel sound signal;

applying source separation processing to the captured multichannel sound signal and obtaining a separation matrix and a set of M sound components, where M≥N;

calculating a set of bivariate first descriptors, representative of statistical relationships between pairs of the obtained set of M sound components;

calculating a set of univariate second descriptors, representative of encoding characteristics of the sound components of the obtained set of M components;

classifying the sound components of the obtained set of M sound components into classes of sound components, comprising a first class of N sound components direct components corresponding to the N direct sound sources and a second class of M-N sound components reverberant components, the classifying being performed by using a calculation of a probability of belonging to one of the first or second classes, the calculation of the probability depending on the set of bivariate first descriptors and the set of univariate second descriptors; and delivering information about the first class and the second class, following the classifying, on an output interface.

2. The method as claimed in claim 1, wherein calculating the set of bivariate first descriptors comprises, for each pair of the obtained set of M sound components calculating a coherence score between the two sound components of the pair of sound components.

3. The method as claimed in claim 1, wherein calculating the set of bivariate first descriptors comprises, for each pair of the obtained set of M sound components, determining a delay between the two sound components of the pair of sound components.

4. The method as claimed in claim 3, wherein the delay between the two sound components of the pair of sound components is determined by taking into account a delay that maximizes an intercorrelation function between the two sound components of the pair.

5. The method as claimed in claim 3, wherein the determination of the delay between the two sound components of the pair of sound components is associated with an indicator of a reliability of a sign of the delay, the indicator of a reliability depending on a coherence between the sound components of the pair.

6. The method as claimed in claim 3, wherein the determination of the delay between the two sound components of the pair of sound components is associated with an indicator of a reliability of a sign of the delay, the indicator of a reliability depending on a ratio of a maximum of an intercorrelation function for delays of an opposing sign.

7. The method as claimed in claim 1, wherein calculating the set of univariate second descriptors is dependent on matching between mixture coefficients of a mixture matrix estimated on the basis of the source separation processing and encoding features of a plane-wave source.

8. The method as claimed in claim 1, wherein the sound components of the set of M sound components are classified by taking into account the obtained set of M sound components and by calculating a most probable combination of the classifications of the obtained set of M sound components.

9. The method as claimed in claim 8, wherein the most probable combination is calculated by determining a maximum of likelihood values expressed as a product of conditional probabilities associated with the descriptors of the set of bivariate first descriptors and the set of univariate second descriptors, for possible classification combinations of the obtained set of M sound components.

10. The method as claimed in claim 8, further comprising performing an act of preselecting possible combinations on the basis of the set of univariate second descriptors before the act of calculating the most probable combination.

11. The method as claimed in claim 1, further comprising performing an act of preselecting the components of the obtained set of M sound components on the basis of the set of univariate second descriptors before the act of calculating the set of bivariate first descriptors.

12. The method as claimed in claim 1, wherein the multichannel sound signal is an ambisonic signal.

13. A sound data processing device implemented so as to perform separation processing of N sound sources of a multichannel sound signal captured by a plurality of sensors in a real environment, wherein the sound data processing device comprises:

an input interface for receiving the captured multichannel sound signal;

a processing circuit containing a processor and configured to control:

a source separation processing module applied to the captured multichannel sound signal in order to obtain a separation matrix and a set of M sound components, where M≥N;

a calculator configured to calculate a set of bivariate first descriptors, representative of statistical relationships between pairs of the obtained set of M sound components and a set of univariate second descriptors, representative of encoding characteristics of the sound components of the obtained set of M sound components;

a classification module configured to classify the sound components of the obtained set of M sound components into classes of sound components, comprising a first class of N sound components as direct components corresponding to the N direct sound sources and a second class of M-N sound components a reverberant components, the classification module using a calculation of a probability of belonging to one of the first or second classes, the calculation of the probability depending on the set of bivariate first descriptors and the set of univariate second descriptors;

an output interface configured to deliver information about the first class and the second class.

14. A non-transitory computer-readable storage medium storing a computer program comprising code instructions for executing a method of processing sound data in order to separate N sound sources of a multichannel sound signal captured in a real environment, when the code instructions are executed by a processor of a sound data processing device, wherein the code instructions configure the sound data processing device to:

receive the captured multichannel sound signal;

apply source separation processing to the captured multichannel sound signal and obtaining a separation matrix and a set of M sound components, where M≥N;

calculate a set of bivariate first descriptors, representative of statistical relationships between pairs of the obtained set of M sound components;

calculate a set of univariate second descriptors, representative of encoding characteristics of the sound components of the obtained set of M sound components;

classify the sound components of the obtained set of M sound components into classes of sound components, comprising a first class of N sound components as direct components corresponding to the N direct sound sources and a second class of M-N sound components as reverberant components, the classifying being performed by using a calculation of a probability of belonging to one of the first or second classes, the calculation of the probability depending on the of bivariate first descriptors and the set of univariate second descriptors; and deliver information about the first class and the second class on an output interface.

* * * * *